United States Patent [19]

Burchett

[11] 3,994,496

[45] Nov. 30, 1976

[54] SPORTS RACKET STRINGING AID

[76] Inventor: Paul James Burchett, 410 Acacia St., Corona Del Mar, Calif. 92625

[22] Filed: Mar. 26, 1973

[21] Appl. No.: 344,978

[52] U.S. Cl. ..... 273/73 A

[51] Int. Cl.[2] ..... A63B 53/14

[58] Field of Search ..... 273/29 BC, 73 A, 73 B; 73/145

[56] References Cited

UNITED STATES PATENTS

| | | | |
|---|---|---|---|
| 890,825 | 6/1908 | Tyer | 273/73 B UX |
| 2,028,663 | 1/1936 | Harroff | 273/73 A |
| 2,156,092 | 4/1939 | Johnson | 273/73 A X |
| 2,268,276 | 12/1941 | Caro et al. | 273/73 B X |

FOREIGN PATENTS OR APPLICATIONS

| | | | |
|---|---|---|---|
| 121,501 | 6/1946 | Australia | 273/73 A |
| 292,508 | 6/1916 | Germany | 273/73 B |
| 213,290 | 2/1961 | Germany | 273/73 A |
| 429,526 | 5/1935 | United Kingdom | 273/73 A |
| 432,813 | 8/1935 | United Kingdom | 273/73 A |
| 1,118,777 | 7/1968 | United Kingdom | 273/73 A |

*Primary Examiner*—Richard J. Apley

[57] ABSTRACT

A portable device for installing transverse strings in a sports racket having previously installed longitudinal strings. One end can be hooked under existing strings for support, while the bottom is held against alternate longitudinal strings by pressure against a handle at the other end. Sliding of a member with undercut notches holds the other alternate longitudinal strings, to maintain transverse clearance for threading new strings into place.

1 Claim, 5 Drawing Figures

SPORTS RACKET STRINGING AID

BACKGROUND OF THE INVENTION

This invention relates to the stringing of sports rackets, and more particularly to the installing of transverse strings after the longitudinal strings are in place. The term "sports racket" is meant to include tennis, badminton and squash rackets.

Installing sports racket strings in the usual manner involves clamping the frame in a support, and first running a thirteen foot string back and forth thru the frame holes to form the longitudinal strings. This part of the operation is quite simple since no crossing of strings is involved.

The longitudinal strings are now tight, and the transverse strings must be threaded between them in an alternating over-and-under fashion. The string material is stiff and the threading operation is difficult and time-consuming. After the front end of the string has been threaded across the width of the frame opening, the remaining length of string must be pulled thru under tension. Friction created by this pulling operation causes considerable wear on all the strings, as well as causing the transverse strings to be installed in a twisted manner. In addition, the maintenance of a constant tension across each string becomes nearly impossible.

The device of my invention might best be described as a supplementary racket stringer. It does not replace present racket stringers, or even the hand-stringer disclosed in my co-pending application Ser. No. 282,192 filed Oct. 11, 1972 and now U.S. Pat. No. 3,837,649. It simplifies the installation of the transverse strings, those which require threading through other strings already installed in a perpendicular direction.

A principal object of my invention is to provide a device to simplify the installation of sports racket strings.

Another object is the provision of a racket stringer that minimizes wear on the strings during installation.

A further object is to provide a racket stringing aid that is readily convertible for use with various longitudinal string spacings.

These and other objects and advantages of the invention will appear from the description which follows and from the drawings.

In brief, the principle of my novel racket stringing aid is as follows: One end of the portable device is hooked under an already installed transverse string. This string thus stabilizes the device while the operator applies downward pressure on the handle portion. The lower edge of the device is notched out to allow an upper set of longitudinal strings to remain unaffected while a lower set of alternating longitudinal strings is deflected downward. When the top of the notches touches the upper set of strings, a slider is moved so that undercuts in the slider notches engage the upper set of strings. The operator can now release the handle pressure, and the transverse clearance between sets of strings will be maintained. He then can freely feed a new transverse string into position without bending it. A Teflon or equivalent tube can be fed thru first, and the new string pulled thru it, substantially reducing the pulling force required. The tube is removed after the entire length of string is pulled thru, and is used repeatedly for each new run across the frame. After the entire assembly is released from the racket by reversing the direction of the slider, the newly inserted string is slid into position adjacent the previously installed transverse string, and tension applied externally by a typical racket stringing device.

Referring now to the drawings.

Figure 1:
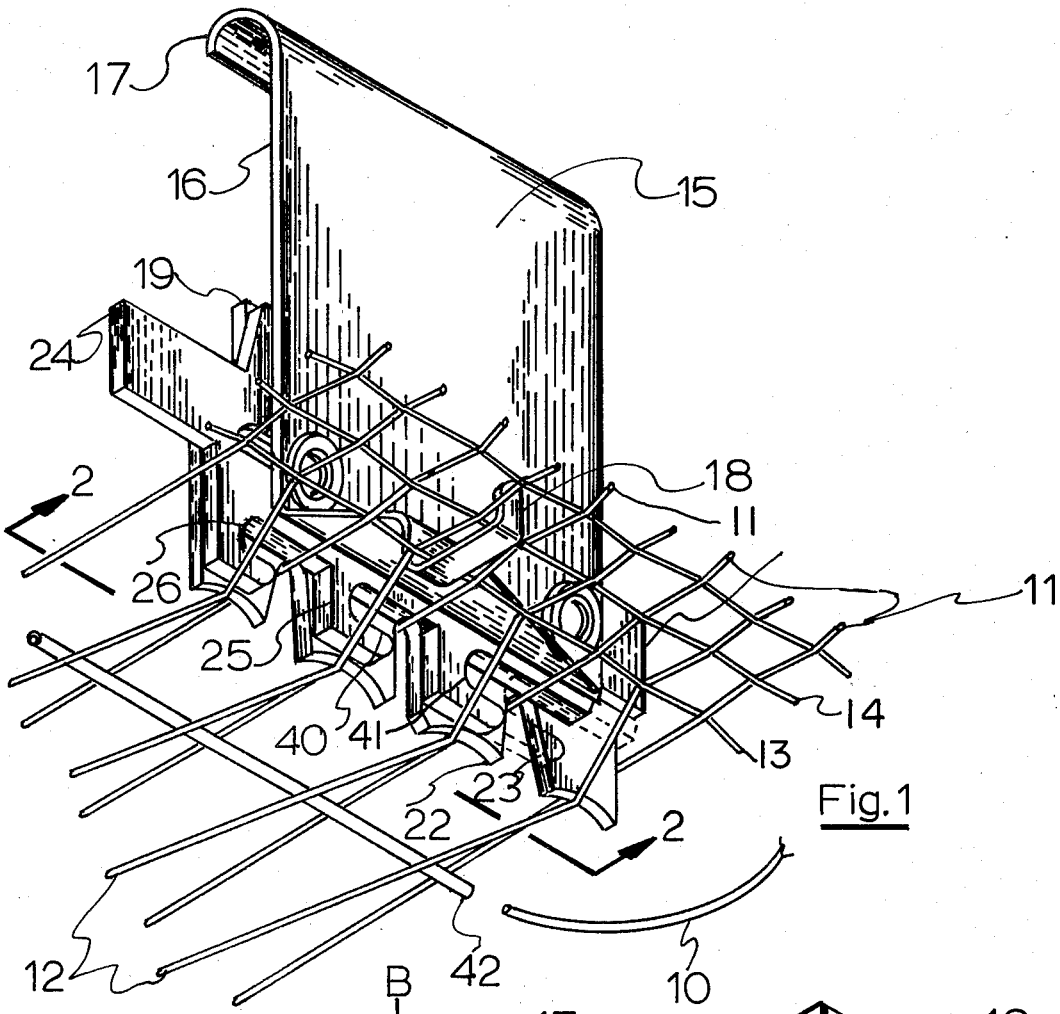
FIG. 1 is a perspective view of my device in claiming position over the strings of a tennis racket, but with the slider still free.

As shown in FIG. 1, the task to be performed with the aid of my novel device is the installation of new transverse string 10 between the upper set of longitudinal strings 11 and the lower set of longitudinal strings 12. Transverse strings 13 and 14 are already installed with 35 to 70 pounds tension in each string. Main body 15 of my device has a central portion 16 connecting to handle portion 17 at one end, and to finger portion 18 at the other end.

Figure 2:
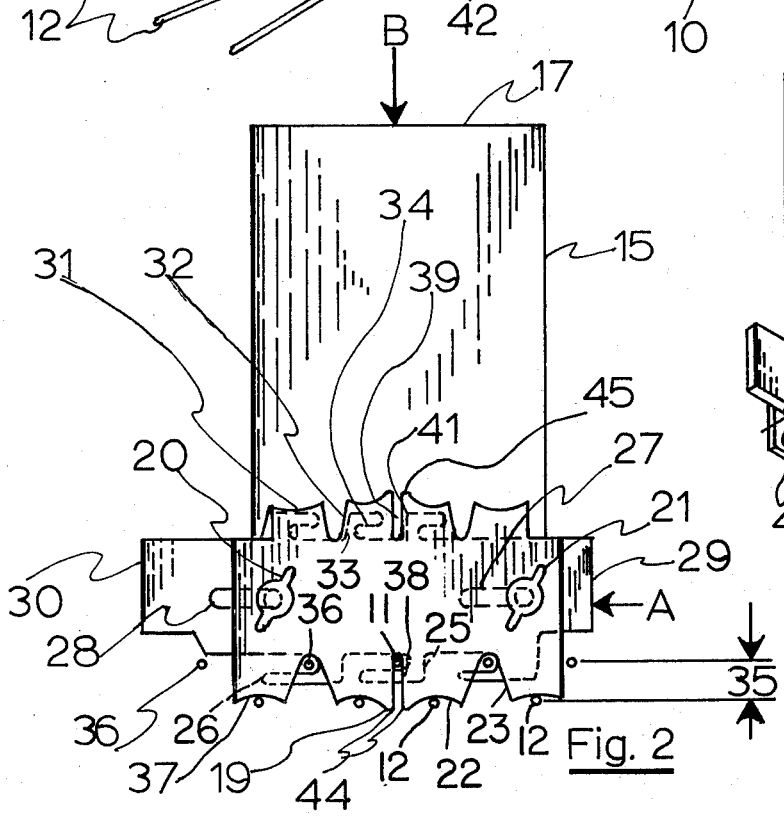
FIG. 2 is a view taken in the direction of arrows 2—2, showing the device clamped in place over the strings.

Detachable guide 19 is firmly attached to lower portion of the main body by two shouldered thumb-screws 20 and 21, best seen in FIG. 2. Concave sections 22 on guide 19 are separated by notches 23, also best seen in FIG. 2. Slider 24 is horizontally movable between guide 19 and central portion 16, and contains notches 25 with undercuts 26 joining one side of each notch. Slots 27 and 28 in slider 24, best seen in FIG. 2, allow slider 24 to move in the direction of arrow A when extension 29 is pressed by hand. Extension 30, at the other end of slider 24, is pressed to return the slider to the original position.

Further reference to FIG. 2 shows guide 19 and slider 24 to have another set of matching notches that are differently spaced from notches 23 and 25. Concave sections 31 on the upper edge of guide 19 are separated by notches 32. The upper edge of slider 24 contains notches 33 with undercuts 34 forming one side of each notch. When downward pressure is exerted on handle portion 17 in the direction of arrow B, the lower set of longitudinal strings 12 is deflected until upper set 11 aligns with undercuts 26 in slider 24. This deflection creates transverse clearance 35 between bottoms 36 of the upper set of strings 11 and tops 37 of the lower set of strings 12. Central notches 38 and 39 in guide 19 are narrower than outer notches 23 and 32, and serve to locate the device relative to one of the upper set of strings 11. Chambers 44 and 45 aid in placing guide 19 over the string. Outer notches 23 and 32 are wider than central notches 38 and 39 to accomodate some variation in the spacings of alternate longitudinal strings. Central notches 40 and 41 in slider 24 are also narrow to correspond to guide notches 38 and 39.

Figure 3:
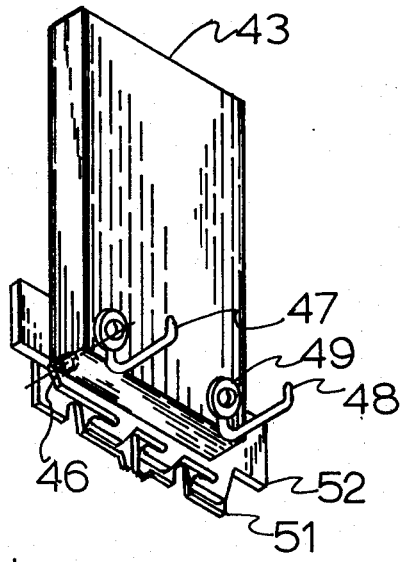
FIG. 3 shows a perspective view of an alternate embodiment.

An alternate embodiment is shown in FIG. 3 and is reversed for left-handed operation. Main body 43 has finger portions 47 and 48 held against main body 43 by screws and wing-nuts 50, thru spacers 46. Stationary guide 51 and slider 52 are also held against main body 43 by screws 49, and have the same notches and operating characteristics as described in FIG. 2 for the preferred embodiment.

Figure 4:
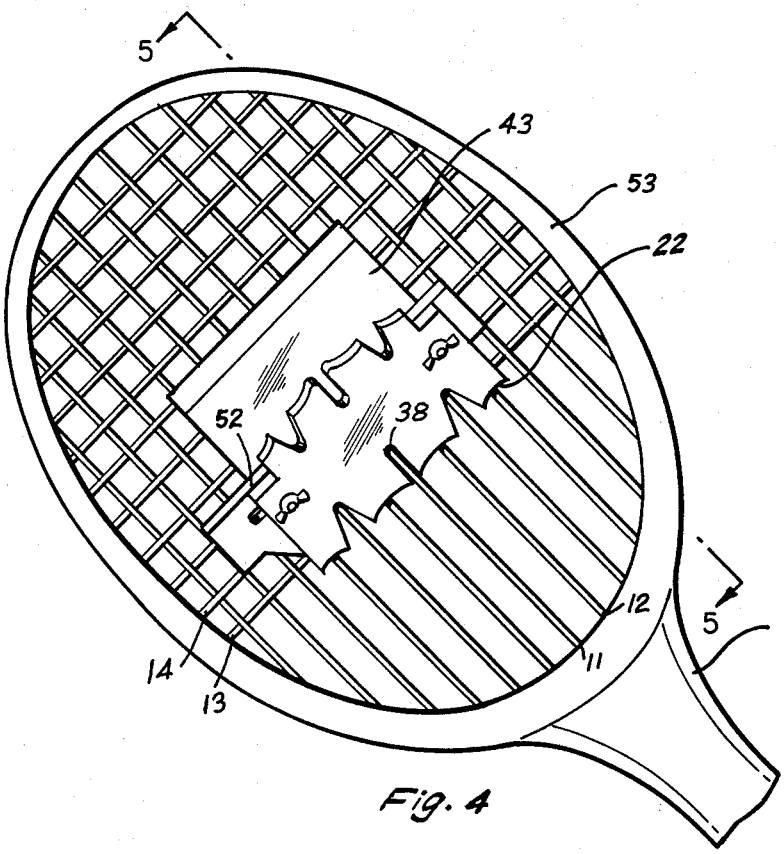
FIG. 4 is a plan view of a tennis racket with the alternate embodiment resting in position before installation.

As shown in FIG. 4, my device is placed over the strings of a tennis racket 53, so that notch 38 in guide aligns with a longitudinal string 11.

Figure 5:
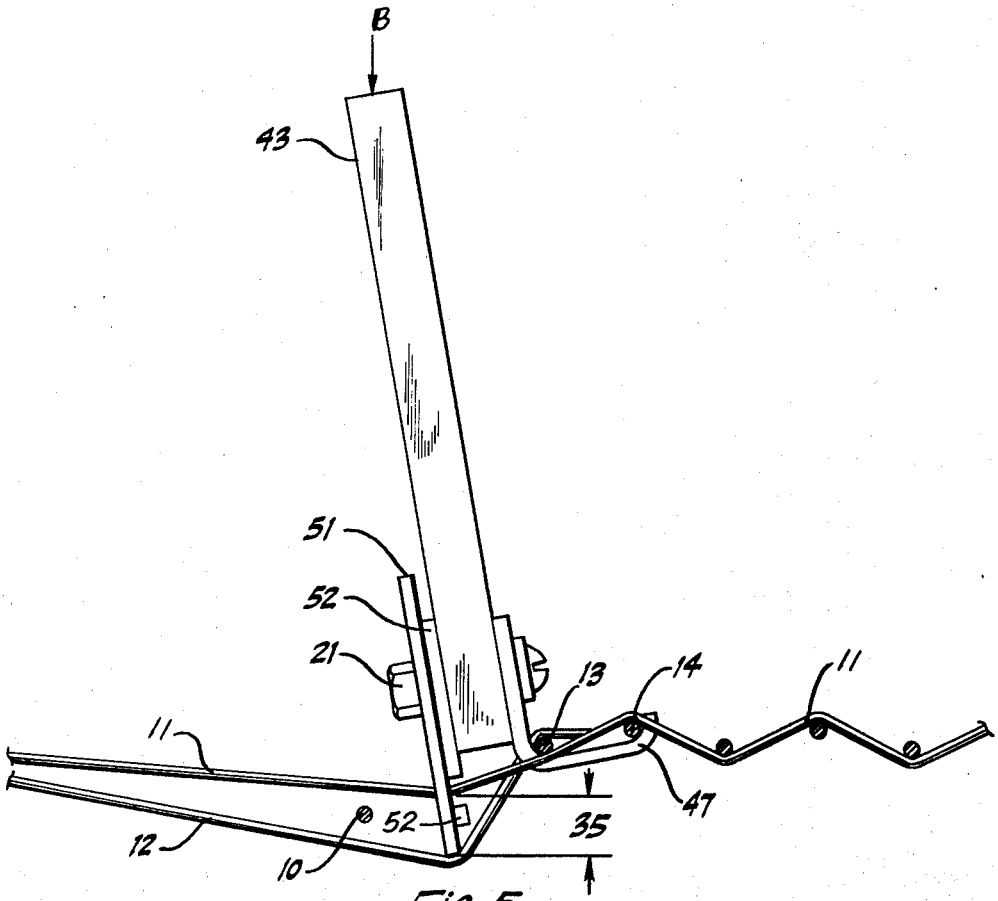
FIG. 5 is a view taken in the direction of arrows 5—5, but with the device locked into place.

As best shown in FIG. 5, after finger portions 47 and 48 are inserted under transverse strings 13 and 14, hand pressure is applied to the top of main body 43 in the direction of arrow B. As main body 43 is deflected downward the bottom surfaces of guide 51 press longitudinal strings 12 down to create clearance 35 below longitudinal strings 11. The lower portion of slider 52 is moved under strings 11 to maintain clearance 35 after the hand pressure is released. Transverse string 10 can then be inserted within clearance 35.

When my novel device is to be used for installing a transverse string in a tennis racket, transverse string 13 must be threaded into place and put under 35 to 70 pounds tension in the known manner. Extension 30 is then pressed to align notches 25 in slider 24 with corresponding notches 23 in guide 19. A set of alternate longitudinal strings that passed over the top of transverse string 13 is aligned with concave sections 22, and finger portion 18, extending perpendicular to the plane of main body 15, is inserted between two adjacent longitudinal strings and under at least on transverse string and under transverse string 13. The concave nature of sections 22 serves to keep strings of set 12 from slipping into the notches in guide 19. Downward pressure is applied by hand on handle portion 17 in the direction of arrow B pivoting the device about finger portion 18 until longitudinal string set 11 aligns with undercuts 26 in slider 24. Extension 29 is then pressed with the thumb, causing slider 24 to move in the direction of arrow A to the ends of slots 27 and 28. This action places string set 11 into undercuts 26 and creates clearance 35 between alternate string sets 11 and 12. Guide 19 and slider 24 are shown assembled for use by a right-handed person, but can be reversed for left-handed use. Transverse clearance 35 will now be maintained even after pressure on handle portion 17 is removed.

New transverse string 10 can now be inserted in a straight line thru transverse clearance 35 and pulled completely thru until tight. Plastic tube 42, preferably made of thin-walled Teflon, can be inserted into transverse clearance 35 and the extra length of string 10 pulled thru the tube to reduce the pulling force required. Tube 42 is then removed from string 10, the string put thru the hole in the racket frame and pulled tight. Slider 24 is then returned to its original position to release longitudinal string set 11 from undercuts 26, and the device removed from all of the racket strings.

The width of the device is chosen so that a reasonable handle force is required. In the case of tennis racket strings, deflecting four of the strings installed with a maximum tensile force of 70 pounds proves reasonable. This width also allows two of the units to be used side-by-side in the central portion of the racket, with one string of set 11 falling between the units. Transverse string 10 can then be run through both clearances 35 at once. If a plastic tube 42 is used, it can be as long as the width of the racket head.

The differently spaced sets of guide notches 23 and 32 allow the use of my device with such differently spaced strings as tennis, badminton and squash. The basic spacing accommodates two ranges of stringing, and the additional widths of the outer notches allow variations within each range. Guide 19 and slider 24 are reversible as a unit, so that notches 32 and 33 cooperate in the same manner as notches 23 and 25 did previously, thus accommodating differently spaced stringing patterns.

It will be readily apparent to those skilled in the art that the specific embodiments described may be modified considerably without departing from the spirit of the invention. For example, a squeezing action on the handle portion could cause the notches to open, or sliding rods within the guide could create the undercuts necessary to maintain the transverse clearance between the longitudinal sets of strings.

Having fully described the present invention, it is to be understood that it is not to be limited to the specific details set forth, but is of the full scope of the appended claims.

I claim:

1. A portable device for installing transverse strings in a sports racket having previously installed longitudinal strings comprising: an elongated main body having an axis paralleling its elongation and having a handle portion at one end and at least one finger portion extending substantially perpendicular to said axis at the other end, said finger portion being adapted to fit under an existing one of said transverse strings, a guide member being detachably secured to the lower portion of said main body by attachment means extending therethrough, said guide member having an alternating plurality of first concave surface portions and first notches on one edge thereof wherein said first concave portions and notches are spaced in a first preselected pattern for engaging the tops of alternate longitudinal strings respectively when downward pressure is applied to said handle portion thereby creating transverse clearance between the longitudinal strings, said guide member further having an alternating plurality of second concave surface portions and second notches on the opposite edge thereof wherein said second concave portions and notches are spaced in a second preselected pattern different than said first preselected pattern for engaging the tops of a differently spaced longitudinal stringing pattern, said first and second notches having their elongation parallel to said main body axis, a slider member detachably mounted to the lower portion of said main body by said attachment means and being located between said guide member and said main body, said slider member having slot means receiving said attachment means thereby permitting said slider member to move in directions transverse to said main body axis, said slider member having one edge formed with a plurality of third notches and undercuts wherein said undercuts are transverse to said main body axis and said third notches are in a third preselected pattern and are located adjacent said first concave portions and notches whereby movement of said slider member permits said undercuts to engage said longitudinal strings located in said first notches and maintain said transverse clearance, said slider member having its opposite edge formed with a plurality of fourth notches and undercuts wherein said undercuts are transverse to said main body axis and said fourth notches and undercuts are in a fourth preselected pattern and are located adjacent said second cancave portions and notches whereby movement of said slider member permits said undercuts to engage said longitudinal strings located in said second notches and maintain said transverse clearance, and said guide and slider members being reversible and reattachable to said main body as a unit to accommodate differently spaced stringing patterns.

* * * * *